US005819370A

United States Patent [19]

Stein

[11] Patent Number: 5,819,370

[45] Date of Patent: Oct. 13, 1998

[54] FLOORCARE MACHINES SUCH AS VACUUM CLEANERS

[75] Inventor: Thomas Stein, Velbert, Germany

[73] Assignee: Stein & Co. GmbH, Velbert, Germany

[21] Appl. No.: 601,349

[22] Filed: Feb. 16, 1996

[30] Foreign Application Priority Data

Feb. 16, 1995 [DE] Germany ..... 195 05 106.8

[51] Int. Cl.[6] ..... A47L 5/34

[52] U.S. Cl. ..... 15/359; 15/372; 15/420

[58] Field of Search ..... 15/354, 372, 420, 15/359, 368

[56] References Cited

U.S. PATENT DOCUMENTS

| | | | |
|---|---|---|---|
| 1,811,350 | 6/1931 | Curry | 15/354 |
| 2,997,730 | 8/1961 | Dierks | 15/368 |
| 3,167,802 | 2/1965 | Pratt et al. | 15/420 X |
| 3,871,051 | 3/1975 | Collier | 15/321 |
| 4,709,442 | 12/1987 | Sletten | 15/354 X |
| 5,101,534 | 4/1992 | Watanabe et al. | 15/420 X |
| 5,347,678 | 9/1994 | Williams et al. | 15/359 X |

*Primary Examiner*—Chris K. Moore
*Attorney, Agent, or Firm*—Nils H. Ljungman and Associates

[57] ABSTRACT

To adjust a brush roller to the current operating conditions, a brush attachment to hold the brush roller and drive mechanism is realized in the form of an upper part and a separate inner part. The inner part is thereby mounted in the upper part so that the inner part can pivot by means of an axle, and the brush roller is pressed against the surface to be cleaned by means of a spring element. The inner part has a suction chamber for the brush roller, and has a rear floor strip, preferably of convex curvature, in the vicinity of the axle to create a seal. The front area is sealed by means of a floor strip on the brush attachment.

20 Claims, 6 Drawing Sheets

FLOORCARE MACHINES SUCH AS VACUUM CLEANERS

BACKGROUND OF THE INVENTION

1. Field of the Invention

The present invention relates to a device for floor care machines, in particular carpet cleaning machines such as vacuum cleaners, in the form of a brush vacuum cleaner which has a powered brush roller, whereby the brush roller with rollers or skid elements is located in a brush attachment which is close to and faces the floor, and wherein, for the purpose of adjusting the brush roller to the current operating conditions, such as the type of floor or floor covering and the brush wear, there are elements which adjust the brush roller in relation to the floor.

2. Background Information

Machines of this type include mechanisms to adjust the height of the brush axle above the floor for various floor coverings, to achieve a good operating result. The nature of the floor or floor covering, such as different types of carpets or bare floors, and the wear of the brushes make such an individual adjustment desirable.

One problem encountered in the operation of vacuum cleaners is that the air flow from the end surfaces of the brush in the suction chamber itself is transported to an intake, whereby air introduced radially and tangentially represents unintentional leakage. For this purpose, floor strips may be located in front of and behind the brush, parallel to the brush, and act as seals. These requirments make it difficult to achieve simple configurations of the mechanism used to make adjustments of the height of the brush roller as a function of the floor covering.

OBJECT OF THE INVENTION

One object of the present invention is to improve such vacuum systems and to create a relative movement between the brush and the floor strips, to thereby make it possible to adjust the brush without changing the seal gap.

SUMMARY OF THE INVENTION

The invention teaches that this object can be accomplished by locating the brush roller with its drive system in an adjustable inner part with the formation of a suction chamber inside the brush attachment, by mounting the inner part in the brush attachment so that the inner part can pivot by means of an axle in the manner of a rocker, by mounting the brush roller by means of a corresponding adjustment element so that it can be pressed against the floor with a pressure which can be set in advance, and by forming a front floor strip on the brush attachment and a rear floor strip in the vicinity of the axle on the inner part.

The invention thereby creates a closed suction system, and when the brush roller is adjusted to the type of floor or floor covering the brush wear, the entire inner part pivots with the rear floor strip. Since the pivot angles are relatively small, and the floor strip is located in the vicinity of the axle, there is no adverse effect on the gap during the adjustment movement. [As the term is used herein, the "gap" refers to the gap between the surface to be cleaned and the seal, most particularly the rear floor strip 14 described below, through which there may be come, albeit small, vacuum leakage. Due to the construction described below (e.g., a rear floor strip seal having a surface extending convexly toward the surface to be cleaned), this gap will remain relatively small and constant as the inventive floor care device self adjusts to surfaces of varying resiliency, pil, etc.] Special consideration has been given to realizing the floor strip as a separate part. In some applications, however, it may also be appropriate to provide a one-piece realization of the floor strip and the corresponding mounting element, e.g., by gating (and/or injection molding).

In one advantageous configuration, the adjustment element is realized in the form of a spring. Of course a set screw or an active adjustment element with its own drive mechanism can also be used.

In one simple configuration, the spring element is provided in the form of a tension spring on the side of the inner part remote from the brush roller. The invention also teaches that, alternatively, the spring element can be located on the axle as a torsion spring (for example, a leg spring).

To limit a pivoting movement outside the working position of the brush roller, the invention teaches that the pivoting movement of the inner part to adjust the brush roller can be limited by means of corresponding stops.

For a good adjustment capability of the floor strip on the inner part, regardless of the pivoting position, the invention teaches that the rear floor strip is preferably realized in the form of a convex sealing surface, at least in the area close to and facing the floor.

The above discussed embodiments of the present invention will be described further hereinbelow with reference to the accompanying figures. When the work "invention" is used in this specification, the work "invention" includes "inventions", that is, the plural of "invention". By stating "invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to one another.

One aspect of the invention resides broadly in a vacuum cleaner for cleaning a surface to be cleaned. The vacuum cleaner includes: a vacuum source; and a power brush attachment for contacting a surface to be cleaned, the power brush attachment being attachable to the vacuum source, the power brush attachment having a normal forward direction of travel and a normal rearward direction of travel, the power brush attachment includes: a housing member; an inner member disposed within the housing member; a pivotal connection of the inner member to the housing member; a rotatable brush member; a rotational axis; the rotatable brush member being rotationally mounted on the inner member about the rotational axis, the rotational axis of the rotatable brush member being disposed on one side of said pivotal connection of the inner member to the housing member; drive means for supplying a rotational torque to the brush member to drive the rotational brush member about the rotational axis; adjustment means for biasing the rotational brush member against a surface to be cleaned; a first sealing member, the first sealing member being disposed on the housing member ahead of the rotatable brush member in the normal forward direction of travel; and a second member, the second member being disposed on the inner member behind the rotatable brush member in the normal forward direction of travel; the distance between the first member and the pivotal connection of the inner member to the housing member being substantially greater than the distance between the second member and the pivotal connection of the inner member to the housing member.

Another aspect of the invention resides broadly in a vacuum cleaner for cleaning a surface to be cleaned, the vacuum cleaner includes: a vacuum source; and a powered brush head connected to the vacuum source for contacting a surface to be cleaned, the powered brush head having a normal forward direction of travel and a normal rearward direction of travel, the powered brush head includes: a housing member; an inner member disposed within the housing member; a pivotal connection of said inner member to the housing member; a rotatable brush member; a rotational axis; the rotatable brush member being rotational mounted on the inner member about the rotational axis, the rotational axis of the rotatable brush member being disposed on one side of the pivotal connection of the inner member to the housing member; drive means for supplying a rotational torque to the brush member to drive the rotational brush member about the rotational axis; adjustment means for biasing the rotational brush member against a surface to be cleaned; a first sealing member, the first being disposed on the housing member ahead of the rotatable brush member in the normal forward direction of travel; and a second member, the second member being disposed on the inner member behind the rotatable brush member in said normal forward direction of travel; the distance between the first member and the pivotal connection of the inner member to the housing member being substantially greater than the distance between the second member and the pivotal connection of the inner member to the housing member.

BRIEF DESCRIPTION OF THE DRAWINGS

Preferred embodiments of the invention are illustrated schematically in the accompanying drawings, wherein.

DESCRIPTION OF THE PREFERRED EMBODIMENTS

Figure 1:
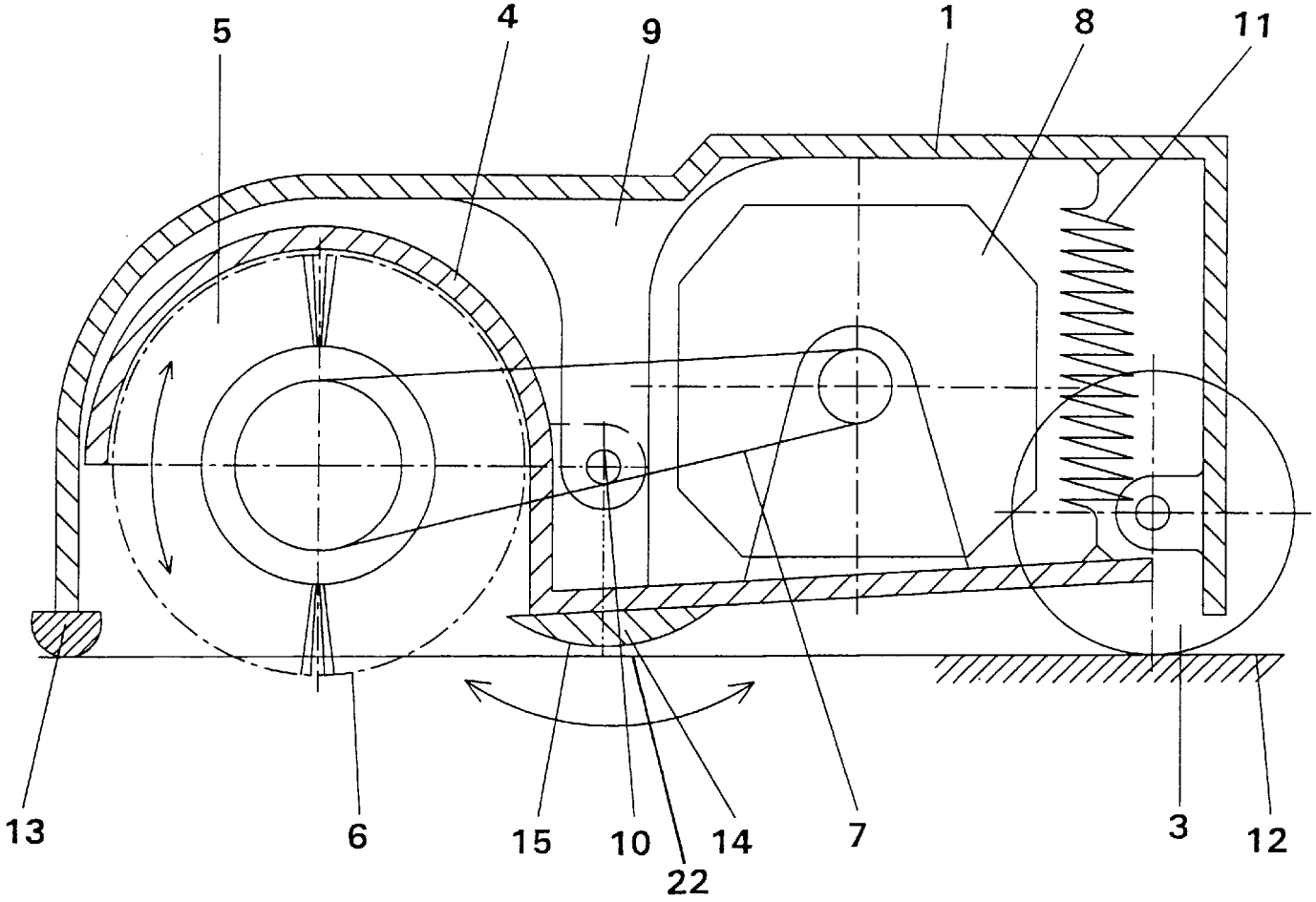
FIG. 1 is an elevational schematic view in cross section through a brush attachment constructed according to the invention, with the front floor strip contacting the floor.
Figure 2:
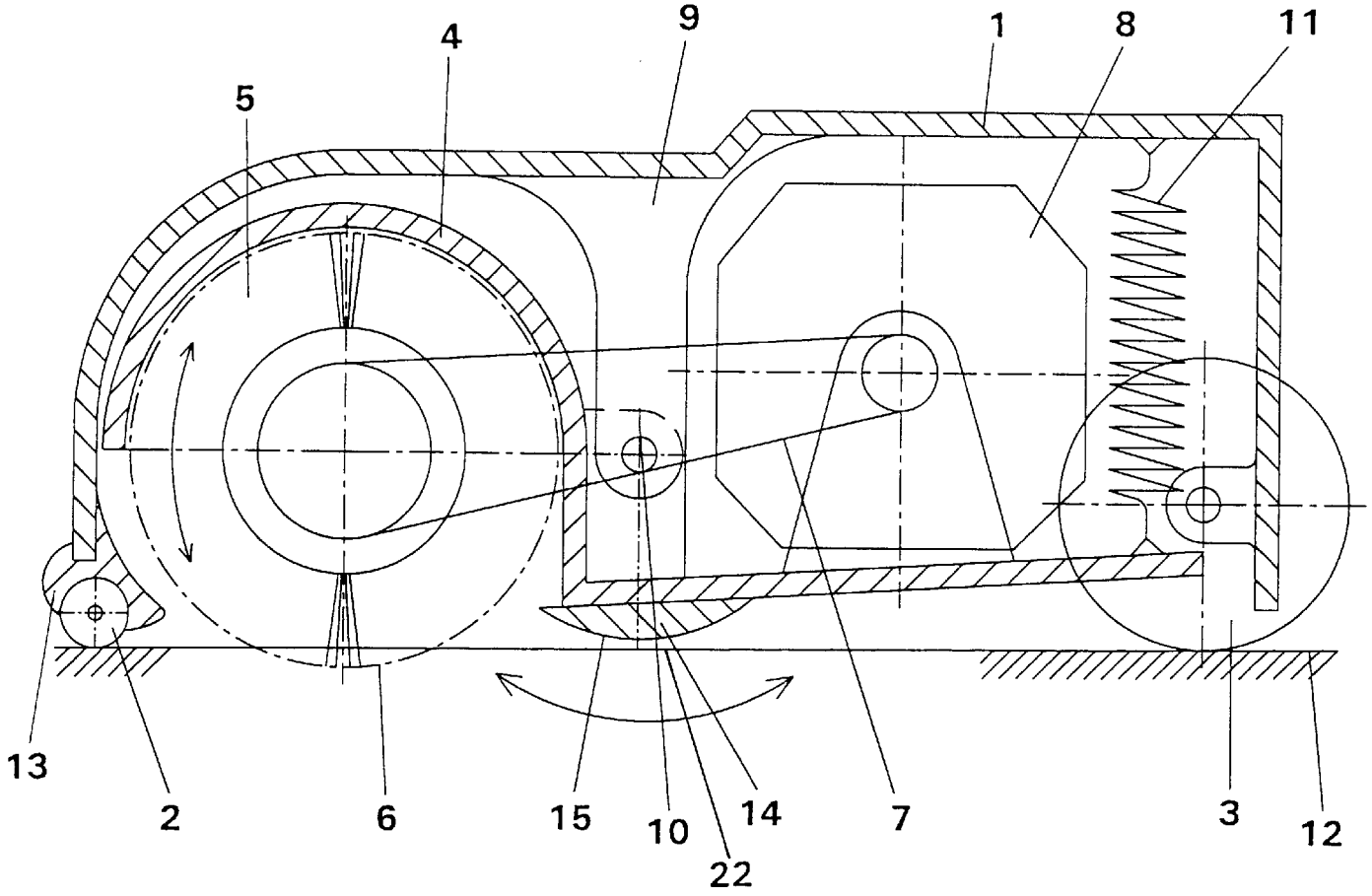
FIG. 2 is an elevational schematic view in cross section of an alternative embodiment of the invention, with roller guidance provided on the front floor strip.

In the illustrated embodiment, FIG. 1 shows the brush attachment 1 provided with a rear roller 3. An inner part 4 is mounted in the manner of an insert within the brush attachment 1. The suction connection and the connections to the suction system between the brush attachment 1 and the inner part 4 are illustrated schematically in FIGS. 3–5. FIG. 2 illustrates an alternative embodiment having both front and rear rollers 2 and 3.

The inner part 4, by means of bearings mounted in the front part thereof, carrier a brush roller 6. The inner part 4 represents a limited suction chamber 5. The brush roller 6 is driven by means of a preferably toothed belt 7 and by a motor 8 which is also located (e.g., mounted) on the inner part 4, so that the brush roller 6 and the motor 8 are fixed in relation to one another by means of the inner part 4. The toothed belt 7 thereby runs outside the actual suction chamber 5.

The brush attachment 1 on its upper part has a locator (or mounting) 9 which supports an axle 10 of the inner part 4, so that the inner part 4 is pivotally mounted on the outer housing of the brush attachment 1 in the manner of a rocker. The rear end of the inner part 4 is connected by means of a tension spring 11 with the outer casing of the brush attachment 1 which serves as the upper part, and the brush roller 6 is thereby pressed against the area of the floor to be cleaned. Consequently, there is a constant contact pressure, depending on the nature of the floor or floor covering.

The suction chamber 5 formed is sealed by a front floor strip 13 on the forward edge of the brush attachment 1, which floor strip 13 is fixed in relation to the floor area 12. A rear floor strip 14 is preferably non-detachably connected to the inner part 4 and presents a convex surface element 15 extending outward toward the area to be cleaned. As a result of the arrangement, in the vicinity of the axle 10, essentially all that is necessary to change the setting of the brush roller 6 is a lateral displacement of the inner part 4, without any significant change in the gap between the brush and the surface 12 being cleaned.

As seen in both of FIGS. 1 and 2 the axle 10 preferably lies along a center of curvature of the convex surface 15. More preferably, the center of curvature of the convex surface 15 is substantially near or coincident with the axle 10.

It can thereby be essentially guaranteed that in spite of the pivoting movement of the brush roller 6, a closed suction chamber is formed.

As seen most particularly in FIGS. 1 and 2, a gap 22 normally exists between the convex surface element 15 of the rear floor strip 14 and the surface 12 being cleaned. Due to the construction of the convex surface element 15 and its positioning near the axle 10 as described above, this "gap" 22 is kept relatively small and of substantially constant dimension, even during any pivoting movement of the inner part 4 and the brush roller 6.

Figure 5:
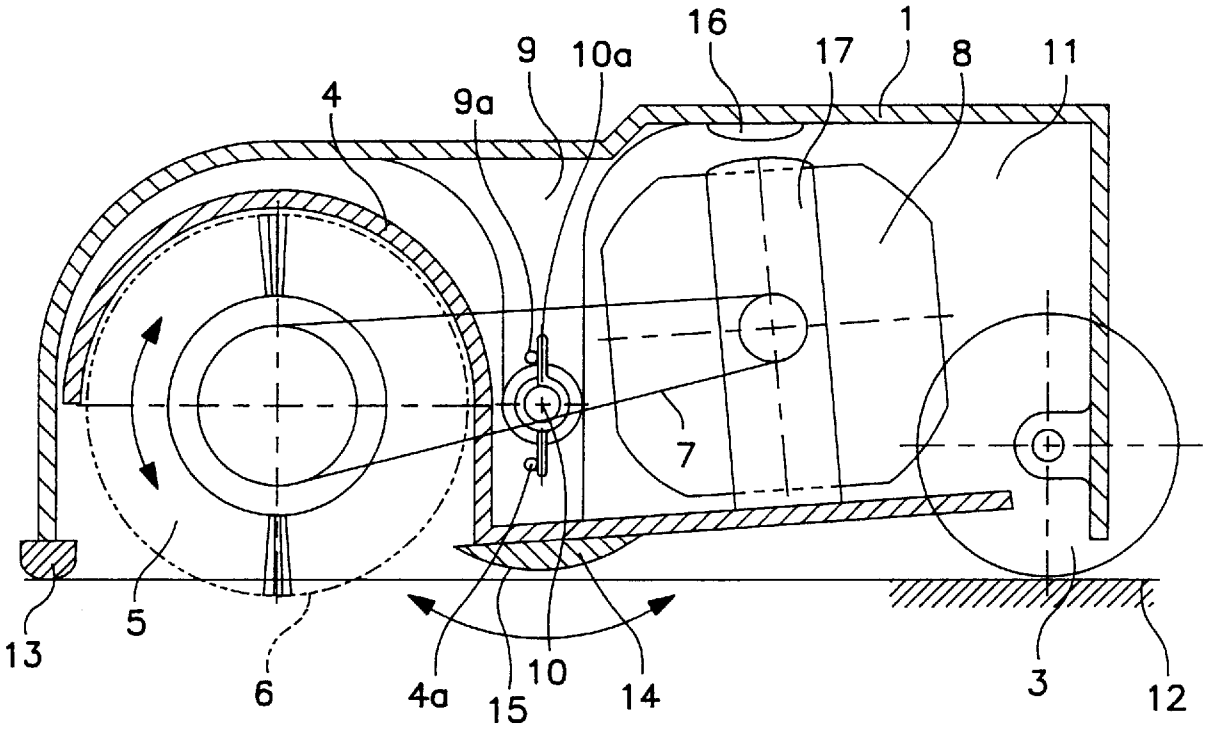
FIG. 5 is a cross-sectional elevational schematic views similar to FIG. 1, but illustrating the use of a torsional spring and a stop mechanism in place of the tension spring shown in 2.

FIG. 5 illustrates one preferred embodiment of the invention wherein the tension spring shown in the embodiments of FIGS. 1 and 2 is replaced with a torsional spring arrangement, In FIG. 5, the mounting 9 which extends downward from the outer housing of the brush attachment 1 includes a lower web portion 9*a* and the inner part 4 includes another web portion 4*a*, the axle 10 by which the outer housing and the inner part 4 are pivotally connected together passes through both of the web portions 9*a* and 4*a*. A torsional spring 10*a* is located about the axle 10 and has two leg portions preferably extending outward from the opposite ends thereof which respectively engage the two web portions 9*a* and 4*a*. The torsional spring 10*a* thus biases the inner part 4 in a counterclockwise rotational direction (as viewed in FIG. 5) with respect to the outer housing of the brush attachment 1 and therefore urges the brush roller 6 in a downward direction toward the surface 12 to be cleaned. Such "torsional springs" having opposing leg portions which can be employed to rotationally bias two members with respect to one another are well known in the mechanical arts and are discussed further below.

Additionally, in order to prevent the brush roller 6 from extending too far outside the outer housing of the brush attachment 1, the brush attachment 1 is preferably provided with at least one stop mechanism for limiting the rotational movement of the inner part 4 with respect to the outer housing. Such a stop mechanism is illustrated in the embodiment of the invention as shown in FIG. 5 in the form of a post 17 extending upwards from the inner part 4, and which allows clockwise rotation thereof but limits the counter-clockwise rotation of the inner part 4 by coming into contact with a stud 16 extending downward from the outer housing of the brush attachment 1. While the stop mechanism is shown in FIG. 5 as being used in conjunction with the torsional biasing mechanism thereof, it will be understood that the stop mechanism of FIG. 5 can be equally well utilized with the tension spring arrangement 11 shown in FIGS. 1 and 2.

Figure 6:
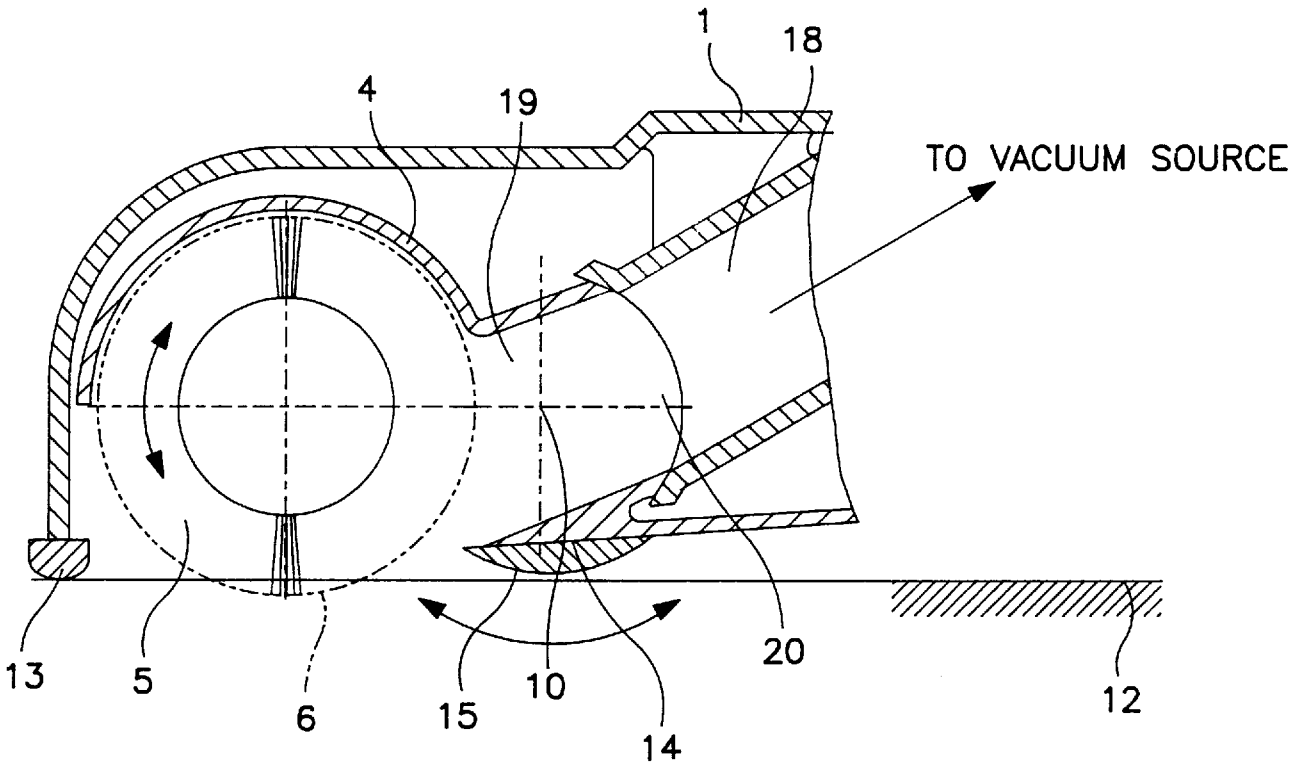
FIG. 6 is a partial cross section elevational schematic view similar to FIG. 1 but illustrating a vacuum connection to the inventive brush attachment.

Additionally, FIG. 6 illustrates a vacuum source which may, for example, be a blower.

Figure 3:
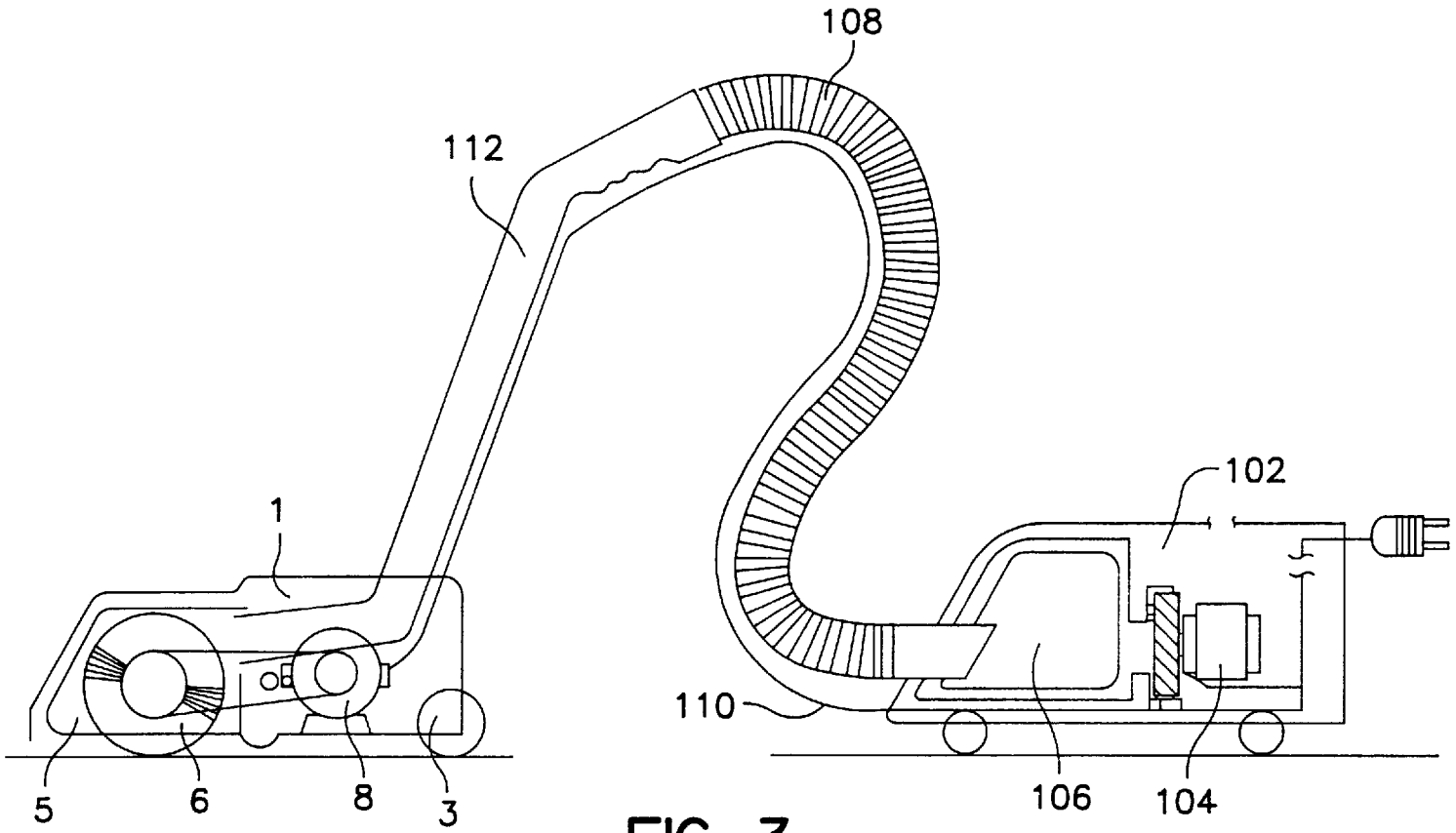
FIG. 3 is a schematic illustration of a so-called "canister" vacuum cleaner utilizing the present invention.

Referring back now to FIGS. 3 and 4, there are shown illustrations of a so-called "canister" vacuum cleaner and a so-called "upright" vacuum cleaner, respectively, wherein the present invention may be embodied. The canister vacuum cleaner of FIG. 3 includes a typical canister 102 which normally has an internal drive motor 104 driving a vacuum source 106 (e.g., a blower). The vacuum created by the vacuum source 106 is customarily transmitted through a flexible vacuum hose 108 to a number of various attachments which may be interchangeably attached thereto. As one of such attachments, the brush attachment 1 of the present invention may be utilized in place of a nonpowered attachment. As illustrated in FIG. 3, the vacuum supplied through the flexible hose 108 is transmitted to the vacuum chamber 5 of the brush attachment 1, and the drive motor 8 of the brush attachment 1 can be supplied with electrical power through an electrical cord 110 located within or along the flexible hose 108. The canister vacuum of FIG. 3 also preferably includes a handle portion 112 extending from the brush attachment 1.

Figure 4:
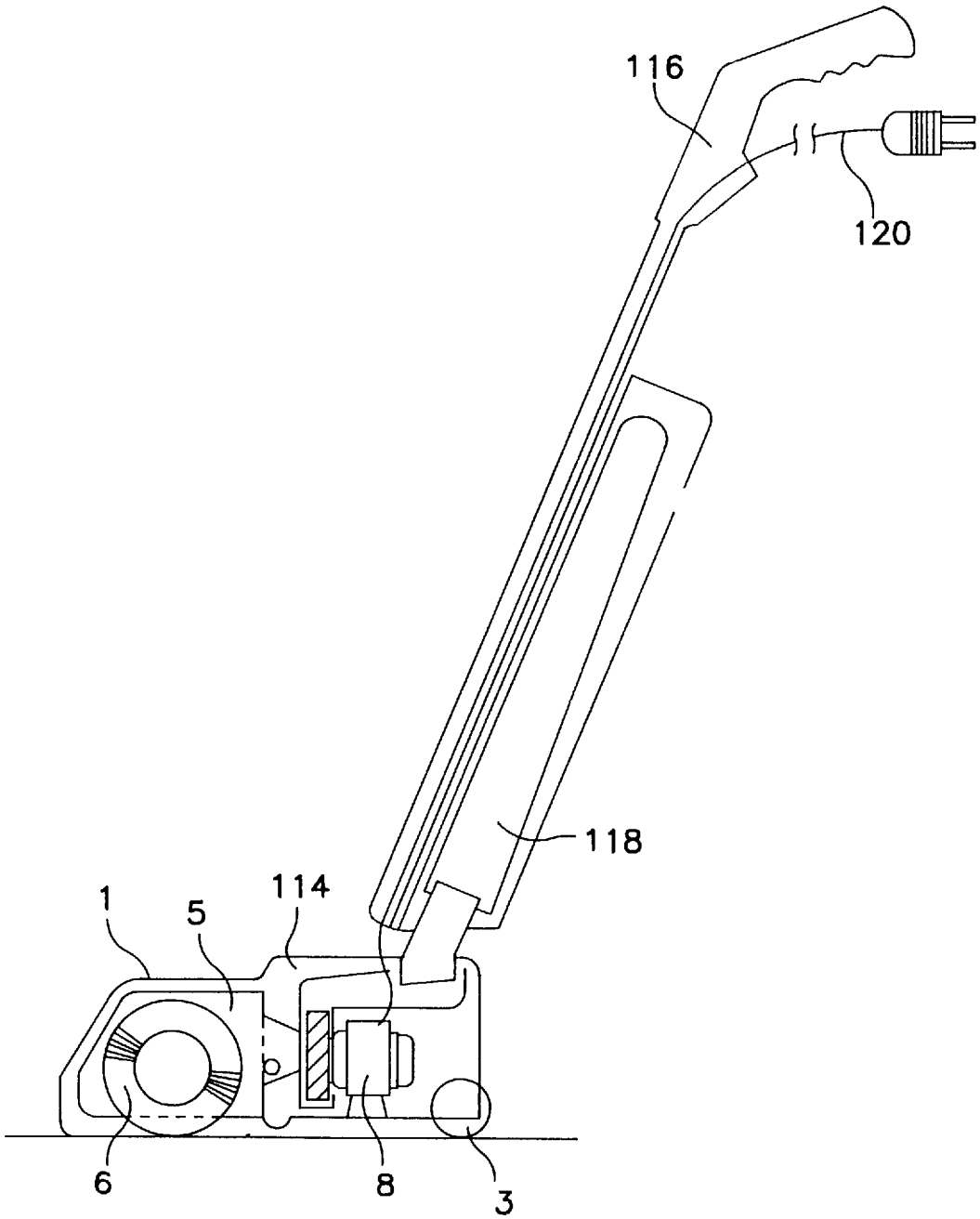
FIG. 4 is a schematic illustration of a so-called "upright" vacuum cleaner utilizing the present invention.

The upright vacuum cleaner of FIG. 4 typically includes a self contained and powered vacuum cleaner head 114, for which the brush attachment 1 of the present invention may be employed, a handle portion 116, and a bag 118 which collects the captured debris and is commonly disposed along the handle 116. The vacuum chamber 5 of the brush attachment 1, 114 may be connected to the bag 118 through the drive motor 8 (or the drive motor 8 connected to a vacuum source, such as a blower, driven thereby), with the drive motor 8 being supplied with electrical power through an electrical cord 120 extending down the handle portion 116. FIG. 6 is similar to FIG. 1 but shows a possible slope of the vacuum channel in the brush attachment 1 from the vacuum chamber 5 to the vacuum source. From the vacuum chamber 5 a vacuum channel 19 in the inner part 4, which inner part is mounted pivotally at the axis 10 on the outer part of the brush attachment 1, slopes over a joint 20 into a vacuum channel 18 of the outer part of the brush attachment 1. The joint 20 maintains and does not limit the possible rotational movement between the inner part 4 and the outer part 1 of the brush attachment inbetween the range of movement and the limits, as shown in FIG. 5, with the post 17 and stud 16. This provides the suction chamber 5 in FIG. 6 being connected with the vacuum source over the suction channel 19, joint 20 and suction channel 18.

While the brush attachment 1 disclosed herein is seen as having applicability to so-called "vacuum cleaners" such as those depicted in FIGS. 3 and 4, it is also seen as having broader applicability to cleaning tasks in general, and is not to be construed as limited to merely the cleaning of floor surfaces. Thus, while the brush attachment 1 may be incorporated into a floor treating device, such as a power head for a vacuum cleaner, a carpet pile lifting device, an integral part of a multifunctional machine, a single motor upright vacuum cleaner, a canister vacuum cleaner, etc., the term "vacuum cleaner" is used herein in its broader literal sense as referring to a device which cleans a surface through the application of a vacuum source.

Some examples of vacuum cleaners and vacuum cleaner systems which may be used in conjunction with the present invention are to be found in U.S. Pat. No. 5,189,757, issued to Williams on Mar. 2, 1993 and entitled "Head Assembly for a Vacuum Cleaning Apparatus"; U.S. Pat. No. 5,216,778 issued to Suzuki et al. on Jun. 8, 1993 and entitled "Vacuum Cleaner"; U.S. Pat. No. 5,230,121, issued to Blackman on Jul. 27, 1993 and entitled "Single Motor Upright Vacuum Cleaner"; U.S. Pat. No. 5,233,682, issued to Abe on Aug. 3, 1993 and entitled "Vacuum Cleaner with Fuzzy Control"; U.S. Pat. No. 5,289,612, issued to Glenn on Mar. 1, 1994 and entitled "Noise Reduction System for Hard Body Vacuum"; U.S. Pat. No. 5,307,537, issued to Essex et al. on May 3, 1994 and entitled "Converter for a Vacuum Cleaner Nozzle"; U.S. Pat. No. 5,308,288, issued to Lackner et al. on May 3, 1994 and entitled "Vacuum Sweeper Drive Belt"; U.S. Pat. No. 5,317,784, issued to Glenn et al. on Jun. 7, 1994 and entitled "Vacuum Power Head with Bare Floor Feature"; U.S. Pat. No. 5,318,479, issued to Lawroski on Jun. 7, 1994 and entitled "Vacuum Cleaner Belt Installation Tool"; U.S. Pat. No. 5,331,716, issued to Hemmann et al. on Jul. 26, 1994 and entitled "Vacuum Cleaner with Extendable Hose and Brush Disengagement"; U.S. Pat. No. 5,255,410, issued to Stein et al. on Oct. 26, 1993 and entitled "Vacuum Cleaner"; U.S. Pat. No. 5,216,779, issued to Glenn on Jun. 8, 1993 and entitled "Upright Soft Bag Type Vacuum Cleaner"; U.S. Pat. No. 5,222,276, issued to Glenn on Jun. 29, 1993 and entitled "Vacuum Cleaner for On Floor and Off Floor Suction Cleaning"; U.S. Pat. No. 5,230,121, issued to Blackman on Jul. 27, 1993 and entitled "Single Motor Upright Vacuum Cleaner"; U.S. Pat. No. 5,233,722 issued to McKnight et al. on Aug. 10, 1993 and entitled "Cleaner Upper Portion with Tool Storage and Door"; U.S. Pat. No. D346,469, issued to Furcron et al. on Apr. 26, 1994 and entitled "Upright Vacuum Cleaner"; U.S. Pat. No. 5,205,013, issued to Lopes on Apr. 27, 1993 and entitled "Combined Decorative Storage Housing and Vacuum Cleaner", each of these patents being expressly incorporated by reference herein.

Some further examples of vacuum cleaners and vacuum cleaner systems which may be utilized in conjunction with the present invention are to be found in U.S. Pat. No. 5,056,175, issued to Stein et al. on Oct. 15, 1991 and entitled "A Floor Cleaning Machine"; U.S. Pat. No. 4,418,342, issued to Aschoff et al. on Nov. 29, 1983 and entitled "Method of and a Circuit for Indicating the Optimum Adjustment of the Working Position of a Brush Roller in an Electrically Operated Floor Cleaning Appliance"; U.S. Pat. No. 4,910,824 issued to Nagayama et al. on Mar. 27, 1990 and entitled "Floor Polisher"; U.S. Pat. No. 4,679,271, issued to Field et al. and entitled Automatic Tool Force Compensator for a Surface Maintenance Machine"; U.S. Pat. No. 4,955,106, issued to Stein et al. on Sep. 11, 1990 and entitled "Upright Vacuum Cleaner"; U.S. Pat. No. 2,210,950, issued to Replogle in August 1940; U.S. Pat. No. 2,343,056, issued to Harlett in February 1944; U.S. Pat. No. 2,867,833, issued to Duff in January, 1959; U.S. Pat. No. 2,898,621, issued to Vance in August, 1959; U.S. Pat. No. 2,898,622, issued to Hurd in August, 1959; U.S. Pat. No. 3,879,797, issued to Principe et al. in April, 1975; U.S. Pat. No. 4,171,553, issued to Stein in October 1979; U.S. Pat.

No. 4,376,322, issued to Lockhart et al. in March, 1983; U.S. Pat. No. 4,573,236, issued to Dyson in March, 1986; U.S. Pat. No. 4,686,736, issued to Petralia et al. in August, 1987; U.S. Pat. No. 4,761,850, issued to Romeo et al. in August, 1988; Federal Republic of Germany Patent No. 3,543,376, issued to Columbus in June, 1987; U.S. Pat. No. 5,028,245, issued to Stein, et al. on Jul. 2, 1991 and entitled "A Vacuum Cleaner Including Filter Bag Mounting Apparatus"; U.S. Pat. No. 4,262,384, issued to Bowers on Apr. 21, 1981 and entitled "Vacuum Cleaner Bag Assembly"; U.S. Pat. No. 4,452,618, issued to Kuplas on Jun. 5, 1984 and entitled "Suction Cleaners with a Bag Transfer Arrangment"; U.S. Pat. No. 4,699,641, issued to Barnes, Jr., on Oct. 13, 1987 and entitled "Support Tray for Disposable Filter"; U.S. Pat. No. 4,705,547, issued to Rotola, Jr. et al. on Nov. 10, 1987 and entitled "Dirt Drawer Latch for Vacuum Cleaner"; U.S. Pat. No. 5,228,169, issued to Stein on Jul. 20, 1993 and entitled "Brush Type Vacuum Cleaner"; U.S. Pat. No. 3,344,460, issued to Nordeen on Oct. 3, 1967 and entitled "Vacuum Cleaner"; U.S. Pat. No. 2,672,642, issued to Tamarin on Mar. 23, 1954 and entitled "Vacuum Cleaner with Concealed Cord-Reel"; U.S. Pat. No. 2,806,242, issued to Sparklin on Sep. 17, 1957 and entitled "Vacuum Cleaner"; U.S. Pat. No. 3,491,519 issued to Ettridge on Jan. 27, 1970 and entitled "Vacuum Cleaner"; U.S. Pat. No. 3,634,905, issued to Boyd on Jan. 18, 1972 and entitled "Electric Vacuum Cleaner Construction"; U.S. Pat. No. 3,675,268, issued to Nordeen on Jul. 11, 1972 and entitled "Vacuum Cleaner"; U.S. Pat. No. D339,433, issued to Stein et al. on Sep. 14, 1993 and entitled "Vacuum Cleaner"; U.S. Pat. No. Des. 319,517, issued to Sovis et al. on Aug. 27, 1991 and entitled "Vacuum Cleaner"; U.S. Pat. No. Des. 316,167, issued to Petralia et al. on Apr. 9, 1991 and entitled "Vacuum Cleaner"; U.S. Pat. No. Des. 309,806, issued to Chieda et al. on Aug. 7, 1990 and entitled "Vacuum Cleaner"; U.S. Pat. No. Des. 301,784, issued to Petralia et al. on Jun. 20, 1989 and entitled "Vacuum Cleaner"; U.S. Pat. No. Des. 293,728, issued to Ohhira et al. on Jan. 12, 1988 and entitled "Vacuum Cleaner"; U.S. Pat. No. Des. 248,762, issued to Burgess et al. and entitled "Upright Vacuum Cleaner"; U.S. Pat. No. 4,955,106, issued to Stein et al. on Sep. 11, 1990 and entitled "Upright Vacuum Cleaner"; U.S. Pat. No. 837,936, issued to King on Dec. 11, 1906 and entitled Carpet Sweeper; U.S. Pat. No. 1,140,752, issued to Leonard on May 25, 1915 and entitled "Vehicle Tire"; U.S. Pat. No. 2,166,977, issued to Smith on Jul. 25, 1939 and entitled "Carpet Sweeper"; U.S. Pat. No. 2,898,622, issued to Hurd on Aug. 11, 1959 and entitled "Combination Suction Cleaners"; U.S. Pat. No. 2,975,461, issued to Hansen on Mar. 21, 1961 and entitled "Vacuum Cleaner Structure"; U.S. Pat. No. 3,031,710, issued to Huening, Jr., on May 1, 1962 and entitled "Vacuum Cleaner with Floating Floor Nozzle Latch Mechanism"; U.S. Pat. No. 5,090,464, issued to Kauzlarich et al. on Feb. 25, 1992 and entitled "Maintenance-Free Vehicle and Cart Tire"; U.S. Pat. No. 5,255,410, issued to Stein et al. on Oct. 26, 1993 and entitled "Vacuum Cleaner"; U.S. patent application Ser. No. 08/463,495, issued to Stein et al. on Jun. 5, 1995 and entitled "Vacuum Cleaner and a Handle for Suction Lines Thereof"; U.S. patent application Ser. No. 08/525,493 issued to Stein et al. on Sep. 8, 1995 and entitled "A Machine, Such as a Vacuum Cleaner, Which Exhausts a Clean Gas, Which Machine has a Protective Bumper", U.S. Pat. No. 4,831,682, issued to White on May 23, 1989 and entitled "Protective Cover for Floor Treating Machine"; U.S. Pat. No. 4,993,105, issued to Buchtel et al. on Feb. 19, 1991 and entitled "Furniture Guard with Exhaust Slots"; each of these patents and patent applications being hereby expressly incorporated by reference herein.

Some examples of torsion springs which may be utilized for the torsion springs 10*a* described above are to be found in U.S. Pat. No. 5,186,412, issued to Park on Feb. 16, 1993 and entitled "Spool Braking Force Switching Device for Fishing Reel"; U.S. Pat. No. 5,193,078, issued to Zink et al. on Mar. 9, 1993 and entitled "Uni-Directional Rotation Device for a Cam-Operated Timer"; U.S. Pat. No. 5,250,009, issued to Sidwell et al. on Oct. 5, 1992 and entitled "Belt Tensioner and Method of Making the Same"; U.S. Pat. No. 5,301,897, issued to Park on Apr. 12, 1994 and entitled "Reel Brake Device of Deck in Camera-Integrated Type Video Cassette Recorder System", each of these patents being hereby expressly incorporated by reference herein.

One feature of the invention resides broadly in the apparatus for floor cleaning machines, in particular carpet cleaning machines, in the form of a brush vacuum cleaner with a powered brush roller, whereby the brush roller with rollers or skid elements is located in a brush attachment which is close to or faces the floor, and to adjust the brush roller to the current operating conditions, such as the type of floor or floor covering being cleaned and the brush wear, there are elements to adjust the brush roller in relation to the floor, characterized by the fact that the brush roller 6 and its drive mechanism 7, 8 are located in an adjustable inner part 4 with the formation of a suction chamber 5 inside the brush attachment 1, and the inner part 4 is mounted in the manner of a rocker so that it can be pivoted in the brush attachment by means of an axle 10 and by means of a corresponding adjustment element 11, the brush roller 6 can be pressed against the floor 12 with a predetermined pressure, and that a front floor strip 13 is formed on the brush attachment 1 and a rear floor strip 14 is located in the vicinity of the axle 10 on the inner part 4.

Another feature of the invention resides broadly in the device characterized by the fact that the adjustment element 11 is realized in the form of a spring.

Yet another feature of the invention resides broadly in the device characterized by the fact that the spring element 11 is located on the side of the inner part 4 farther from the brush roller 6.

Still another feature of the invention resides broadly in the device characterized by the fact that the spring element 11 is located on the axle 10 as a torsion spring.

A further feature of the invention resides broadly in the device characterized by the fact that the pivoting movement of the inner part 4 for the adjustment of the brush roller 6 can be restricted by corresponding stops.

Another feature of the invention resides broadly in the device characterized by the fact that the rear floor strip 14 is realized in the form of a convex sealing surface 15, at least in the area close to the floor 12.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. 195 05 106.8, filed on Feb. 16, 1995, having inventor Thomas Stein, and DE-OS 195 05 106.8 and DE-PS 195 05 106.8, as well as their published equivalents, and other equivalents or corresponding applications, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. A vacuum cleaner for cleaning a surface to be cleaned, said vacuum cleaner comprising:

a vacuum source; and a power brush attachment for contacting a surface to be cleaned, said power brush attachment being operatively connectable to said vacuum source, said power brush attachment having a normal forward direction of travel and a normal rearward direction of travel, said power brush attachment comprising:

a housing member;

an inner member disposed within said housing member;

said inner member being operatively connected to said vacuum source;

said inner member forming at least in part a suction chamber;

a pivotal connection of said inner member to said housing member;

a rotatable brush member;

said rotatable brush member having a rotational axis;

said rotatable brush member being rotationally mounted on said inner member about the rotational axis, said rotatable brush member being disposed on one side of said pivotal connection of said inner member to said housing member;

drive means for supplying a rotational torque to said brush member to drive said rotatable brush member about said rotational axis;

adjustment means for biasing said rotatable brush member against a surface to be cleaned;

a first floor strip, said first floor strip being disposed on said housing member ahead of said rotatable brush member in said normal forward direction of travel to be disposed between said housing member and a surface to be cleaned upon use of said vacuum cleaner; and a second floor strip, said second floor strip being disposed on said inner member behind said rotatable brush member in said normal forward direction of travel to be disposed between said inner member and a surface to be cleaned upon use of said vacuum cleaner, to provide a substantially constant gap between said second floor strip and the surface to be cleaned upon said inner member pivoting within said housing member.

2. A vacuum cleaner according to claim 1, wherein said drive means is mounted on said inner member.

3. A vacuum cleaner according to claim 2, wherein:

said pivotal connection of said inner member to said housing member has a pivotal axis; and said adjustment means comprises biasing means for rotationally biasing said inner member about said pivotal axis to thereby bias said rotatable brush member into contact with a surface to be cleaned.

4. The vacuum cleaner according to claim 3, wherein said second floor strip is disposed substantially adjacent to said pivotal connection to thus provide a substantially constant gap between said second floor strip and the surface to be cleaned upon the pivoting of said inner member.

5. A vacuum cleaner according to claim 4, wherein said rotational biasing means comprises a spring member connected to and extending between said inner member and said housing member.

6. A vacuum cleaner according to claim 5, wherein said pivotal connection of said inner ember to said housing member is disposed between said rotational axis of said rotatable brush member and said connection of said spring member to said inner member.

7. A vacuum cleaner according to claim 6, wherein said power brush attachment additionally comprises at least one stop member disposed to permit contact with said inner member, said at least one stop member limiting the rotation of said inner member relative to said housing member about said pivotal connection of said inner member to said housing member.

8. A vacuum cleaner according to claim 7:

wherein said second floor strip comprises an elongated member having a convex surface extending toward a surface to be cleaned when said power brush attachment is in contact with a surface to be cleaned; and wherein said pivotal connection of said inner member to said housing member lies substantially along a radius of curvature of said convex surface; and wherein said convex surface has a center of curvature substantially coincident with said pivotal connection of said inner member to said housing member.

9. A vacuum cleaner according to claim 4, wherein said rotational biasing means comprises a torsional spring for applying a rotational torque to said inner member about said pivotal connection of said inner member to said housing member.

10. A vacuum cleaner according to claim 2:

wherein said second floor strip comprises an elongated member having a convex surface extending toward a surface to be cleaned when said power brush attachment is in contact with a surface to be cleaned; and wherein said pivotal connection of said inner member to said housing member lies substantially along a radius of curvature of said convex surface.

11. A surface treating device for cleaning a surface to be cleaned, for use with a vacuum source; said surface treating device comprising:

a powered brush head operatively connected to a vacuum source for contacting a surface to be cleaned, said powered brush head having a normal forward direction of travel and a normal rearward direction of travel;

said powered brush head comprising:

a housing member;

an inner member disposed within said housing member;

said inner member being operatively connected to said vacuum source;

said inner member forming at least in part a suction chamber;

a pivotal connection of said inner member to said housing member;

a rotatable brush member;

said rotatable brush having a rotational axis;

said rotatable brush member being rotationally mounted on said inner member about the rotational axis, said rotatable brush member being disposed on one side of said pivotal connection of said inner member to said housing member;

drive means for supplying a rotational torque to said brush member to drive said rotatable brush member about said rotational axis;

adjustment means for biasing said rotatable brush member against a surface to be cleaned;

a first floor strip, said first floor strip being disposed on said housing member ahead of said rotatable brush member in said normal forward direction of travel to be disposed between said housing member and a surface to be cleaned upon use of said surface treating device; and a second floor strip, said second floor strip being disposed on said inner member behind said rotatable brush member in said normal forward direction of travel to be disposed between said inner member and a surface to be cleaned upon use of said surface treating device, to provide a substantially constant gap between said second floor strip and the surface to be cleaned upon said inner member pivoting within said housing member.

12. A surface treating device according to claim 11, wherein said drive means is mounted on said inner member.

13. A surface treating device according to claim 12, wherein:

said pivotal connection of said inner member to said housing member has a pivotal axis; and said adjustment means comprises biasing means for rotationally biasing said inner member about the pivotal axis to thereby bias said rotatable brush member into contact with a surface to be cleaned.

14. The surface treating device according to claim 13, wherein said second floor strip is disposed substantially adjacent to said pivotal connection to thus provide a substantially constant gap between said second floor strip and the surface to be cleaned upon the pivoting of said inner member.

15. A surface treating device according to claim 14, wherein said rotational biasing means comprises a spring member connected to and extending between said inner member and said housing member.

16. A surface treating device according to claim 15, wherein said pivotal connection of said inner member to said housing member is disposed between said rotational axis of said rotatable brush member and said connection of said spring member to said inner member.

17. A surface treating device according to claim 16, wherein said power brush attachment additionally comprises at least one stop member disposed to permit contact with said inner member, said at least one stop member limiting the rotation of said inner member relative to said housing member about said pivotal connection of said inner member to said housing member.

18. A surface treating device according to claim 17:

wherein said second floor strip comprises an elongated member having a convex surface extending toward a surface to be cleaned when said power brush attachment is in contact with a surface to be cleaned;

wherein said pivotal connection of said inner member to said housing member lies substantially along a radius of curvature of said convex surface; and wherein said convex surface has a center of curvature substantially coincident with said pivotal connection of said inner member to said housing member.

19. A surface treating device according to claim 14, wherein said rotational biasing means comprises a torsional spring for applying a rotational torque to said inner member about said pivotal connection of said inner member to said housing member.

20. A surface treating device according to claim 12:

wherein said second floor strip comprises an elongated member having a convex surface extending toward a surface to be cleaned when said power brush attachment is in contact with a surface to be cleaned; and wherein said pivotal connection of said inner member to said housing member lies substantially along a radius of curvature of said convex surface.

* * * * *

UNITED STATES PATENT AND TRADEMARK OFFICE

CERTIFICATE OF CORRECTION

PATENT NO. : 5,819,370

DATED : October 13, 1998

INVENTOR(S) : Thomas STEIN

It is certified that error appears in the above-identified patent and that said Letters Patent is hereby corrected as shown below:

In column 1, line 56, after 'covering', delete "the" and insert --and--.

In column 2, line 1, after 'resiliency,' delete "pil," and insert --pile,--.

In column 2, line 27, after the second occurrence of 'the', delete "work" and insert --word--.

In column 2, line 28, after 'the', delete "work" and insert --word--.

In column 3, line 11, after 'being', delete "rotational" and insert --rotationally--.

UNITED STATES PATENT AND TRADEMARK OFFICE

CERTIFICATE OF CORRECTION

PATENT NO. : 5,819,370

DATED : October 13, 1998

INVENTOR(S) : Thomas STEIN

It is certified that error appears in the above-identified patent and that said Letters Patent is hereby corrected as shown below:

In column 3, line 47, after 'in' insert --FIGS. 1 and--.

In column 7, line 11, after 'Transfer', delete "Arrangment";" and insert --Arrangement";--.

In column 10, line 21, Claim 6, after 'inner', delete "ember" and insert --member--.

Signed and Sealed this

Twentieth Day of April, 1999

*Attest:*

*Attesting Officer*

Q. TODD DICKINSON

*Acting Commissioner of Patents and Trademarks*